United States Patent [19]

Schuster

[11] Patent Number: 4,913,291

[45] Date of Patent: Apr. 3, 1990

[54] SEPARABLE ARTICLE CARRIER

[75] Inventor: Richard L. Schuster, Monroe, La.

[73] Assignee: Manville Corporation, Denver, Colo.

[21] Appl. No.: 291,722

[22] Filed: Dec. 29, 1988

[51] Int. Cl.[4] ..... B65D 5/54

[52] U.S. Cl. ..... 206/602; 229/120.03; 229/120.11

[58] Field of Search ..... 206/602, 611, 620; 229/120.03, 120.08, 120.11, 120.17

[56] References Cited

U.S. PATENT DOCUMENTS

| | | | |
|---|---|---|---|
| 2,973,130 | 2/1961 | Cottrill | 206/602 |
| 3,048,321 | 8/1962 | Sanford | 206/602 |
| 3,135,457 | 6/1964 | Risucci | 206/602 |
| 3,341,103 | 9/1967 | May | 206/602 |
| 3,677,458 | 7/1972 | Gosling | 206/602 |

FOREIGN PATENT DOCUMENTS

| | | | |
|---|---|---|---|
| 630528 | 4/1963 | Belgium | 206/602 |
| 739899 | 11/1955 | United Kingdom | 206/602 |

*Primary Examiner*—Gary Elkins
*Attorney, Agent, or Firm*—John D. Lister

[57] ABSTRACT

An article carrier which has an interior partition dividing the carrier in half. The partition is comprised of two unconnected face-to-face sheets of material, one being connected to a first top panel section at the center of the top panel and the other being connected to a second top panel section adjacent the first top panel section. The bottom and end panels contain weakened areas. When the weakened areas are separated the adjacent unconnected partition sheets become side panels in two smaller carriers. End panel flaps include weakened areas for allowing the end panels to separate when the carrier is broken down into two separate carriers.

2 Claims, 4 Drawing Sheets

SEPARABLE ARTICLE CARRIER

FIELD OF THE INVENTION

This invention relates to article carriers of the type capable of carrying one or more rows of cans or bottles. More particularly, it relates to an article carrier of this type which can be separated into smaller carrier units.

BACKGROUND OF THE INVENTION

It is generally more economical to ship articles in larger packages rather than smaller ones. To do so, however, often results in small distributors or retail stores being forced to order articles from a manufacturer in quantities which are more than they need because the articles are available only in large size packages. Although to provide small size packages is not economically desirable to the manufacturer, to provide only large size packages may result in less business, which leaves the manufacturer in a dilemma.

One way to solve the problem is to package products in large size carriers which can be broken down into smaller units for shipment to those customers who only need small quantities. Such a package has to be able to formed in the usual manner by existing or only slightly modified packaging equipment in order to avoid unjustifiable investments in new equipment. It also has to be sufficiently strong and sturdy to remain intact when subjected to the normal stresses of handling and shipping while still being capable of being readily broken down by hand into smaller units on demand. Further, the design cannot be too complicated or require excessive amounts of paperboard since this would drive the costs too high. Until the present invention, no practical carrier meeting these specifications has been available.

SUMMARY OF THE INVENTION

This invention provides a separable article carrier which comprises top and bottom panels connected along the length of the carrier to side panels, with either the top or bottom panel containing a weakened area extending along the length of the panel. The other top or bottom panel is comprised of first and second panel sections foldably connected to the side panels. Each panel section is connected by a fold line to a partition which extends down into the interior of the carrier in adjacent face-to-face relationship with the other partition and in generally parallel relationship to the side panels of the carrier. Each partition is connected to the panel containing the weakened portion on opposite sides of the weakened area. The carrier can be separated into two smaller carriers by tearing the weakened area of the panel to allow the adjacent but unconnected partitions to be separated and become the side panels of two smaller carriers.

A handle which can be employed in both the larger size carrier and in the smaller carriers is provided on the top panel. In addition, end panels are provided which allow the carrier to be completely closed and yet be separated in the manner explained above. Preferably, the end panels are comprised of flaps which are connected to each other and also to the top and bottom panels, with the end panels containing weakened areas aligned with the weakened area of the top or bottom panel. Dust flaps can also be provided to function in the usual manner.

One of the end flaps is comprised of two adjacent flaps connected to the first and second panel sections.

These end flaps are adjacent but unconnected except for a tab or flap which extends from one of the flaps and is connected to the other. This tab aids in aligning the flaps during formation and secures the flaps together. In addition, it contains a weakened area aligned with the weakened area of the other main end flap to enable the package to be separated into two separate units.

The carrier is formed from a single sheet of material, such as paperboard, and is easily folded into shape. Although any adequate means of holding the blank together in carrier shape may be used, glue tabs are preferred because they minimize the fastening steps and provide strong connections. The partitions, for example, are readily connected to the opposing panel at the correct location by glue tabs positioned on opposite sides of the weakened portions of the opposing panel.

The foregoing aspects of the invention, as well as other benefits thereof, will readily be ascertained from the more detailed description of the invention which follows.

DESCRIPTION OF THE PREFERRED EMBODIMENT

Figure 1:
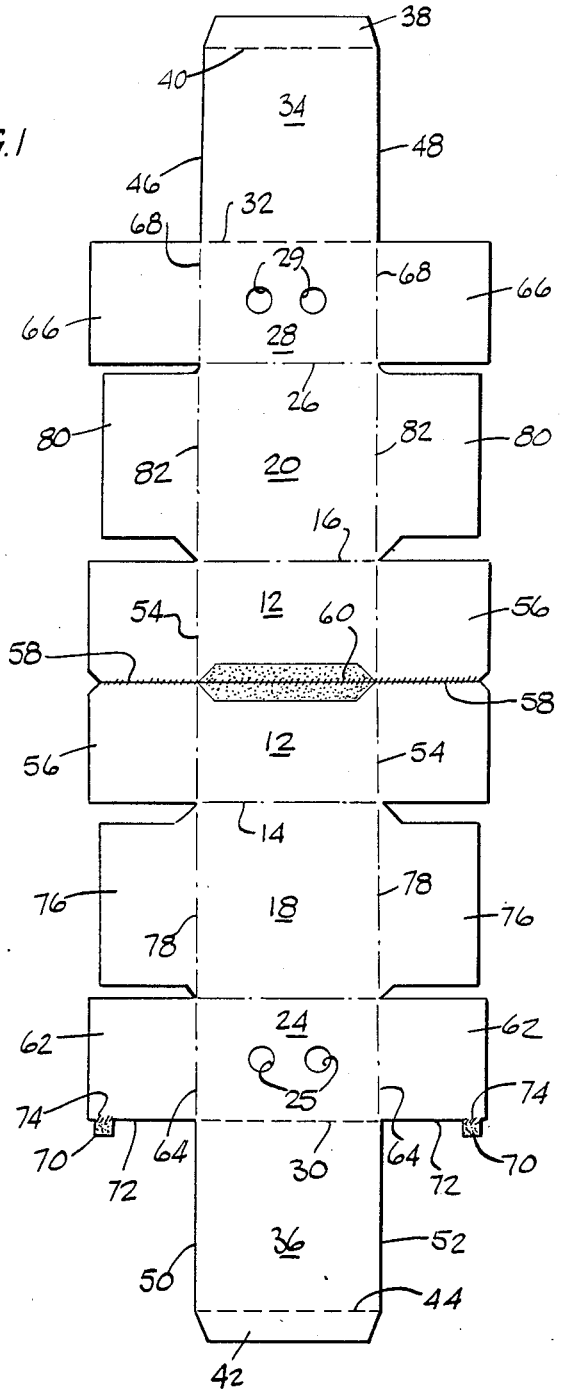
FIG. 1 is a plan view of the inside surface of a blank for forming the separable carrier of the present invention.

Referring to FIG. 1, the generally rectangular blank 10 comprises a centrally located bottom section 12 connected by fold lines 14 and 16 to side panel sections 18 and 20, respectively. The side panel section 18 is connected by fold line 22 to a first top panel section 24, while the side panel section 20 is connected by fold line 26 to a second top panel section 28. The top panel section 24 contains two finger holes 25 while the top panel section 28 also contains two finger holes 29. Connected to the top panel sections 24 and 28 by fold lines 30 and 32 are partition sections 34 and 36, respectively. A glue flap 38 is connected to the end of the partition section 34 by fold line 40. Similarly, a glue flap 42 is connected to the end of the partition section 36 by fold line 44. The various fold lines referred to are all substantially parallel to each other and to the ends of the blank, and in addition they extend across the full width of the blank. The width of the blank corresponds to the distance between the edges 46 and 48 of partition section 34, which is the same as the distance between the edges 50 and 52 of partition section 36.

Connected to the bottom panel section 12 along fold lines 54 are end panel flaps 56, each of which contains a weakened area located midway between the ends of the flaps 56 and extending substantially parallel to the the fold lines 14 and 16. Connecting the inner ends of the weakened areas 58 and extending across the width of the bottom panel section is another weakened area 60. The weakened areas 58 and 60 allow major sections of the carrier to be separated as described in greater detail below.

End panel flaps 62 are connected to the top panel section 24 along fold lines 64, and end panel flaps 66 are connected to the top panel section 28 by fold lines 68. Tabs 70 are connected to the end flaps 62 along the flap edges 72 by weakened areas 74. The tabs are adapted to be connected to the end flaps 66 in a carrier formed from the blank and to be separated along the weakened areas 74 as described in more detail hereinafter.

Dust flaps 76 are connected to the side panel section 18 along fold lines 78, while dust flaps 80 are connected to the side panel section 20 along fold lines 82. The fold lines by which the end flaps and dust flaps are connected to the various panel sections are aligned with the partition section edges 46, 50 and 48, 52, and are perpendicular to the fold lines connecting the various panel sections to one another.

Still referring to FIG. 1, the first step in erecting a carrier from the blank 10 is to apply adhesive to the stippled area adjacent the weakened area 60. The stippled area on either side of the weakened portion corresponds generally to the shape of the glue flaps 38 and 42. Adhesive is also applied to the tabs 70. Remembering that the surface of the blank facing the viewer corresponds to the inside surface of the carrier, the blank is then folded about fold lines 14, 22, 30 and 44 to bring the outside surface of the glue flap 42 into face-to-face contact with the adhesive on the near side of the weakened area 60. Similarly, the blank is folded about fold lines 16, 26, 32 and 40 to bring the outside surface of the other glue flap 38 into face-to-face contact with the adhesive on the near side of the weakened area 60. Of course the folding operation may be simultaneous so that the glue flaps 38 and 42 are folded into place at the same time rather than in sequence.

Figure 2:
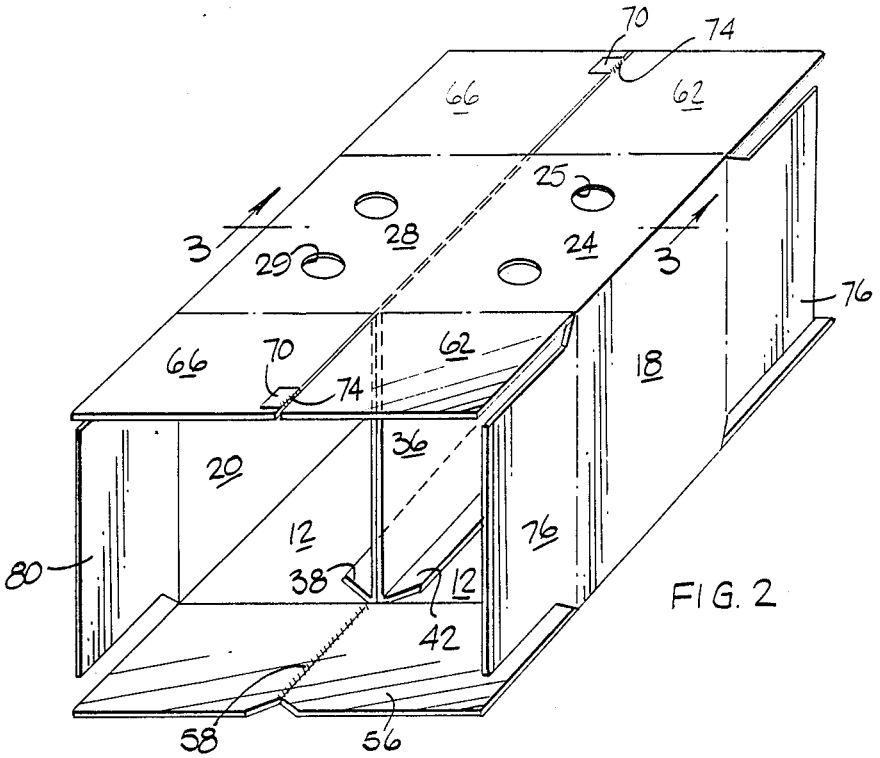
FIG. 2 is a pictorial view of the carrier at an intermediate stage in its formation.

The result of the folding and gluing operation is shown in FIG. 2, which illustrates a partially formed carrier. The end flaps 62 are connected to the end flaps 66 by the glued tabs 70 to cause the connected end flaps 62 and 66 to function at this point as a unit. The end flaps 62, 66 and 56 and the dust flaps 76 and 80 have not yet been folded in, leaving the partially formed carrier in the shape of an open-ended sleeve.

As shown in detail in FIGS. 2, 3, 4, and 5, in folding the panel sections to produce the partially formed carrier of FIG. 2 the top panel sections 24 and 28 are not connected to each other but are closely adjacent. Their fold lines 30 and 32 are substantially abutting and the depending partitions 34 and 36 are in substantial face-to-face contact. At the bottom of the partitions the glue strips 38 and 42 are adhered to the inside surface of the bottom panel 12 on either side of the weakened area 60. At this point in the formation of the carrier, therefore, the sleeve is held together only along the glue strips 38 and 42 and at the tabs 70, with the top panel sections 24 and 28 being unconnected and the partitions 34 and 36 also being unconnected.

Figure 6:
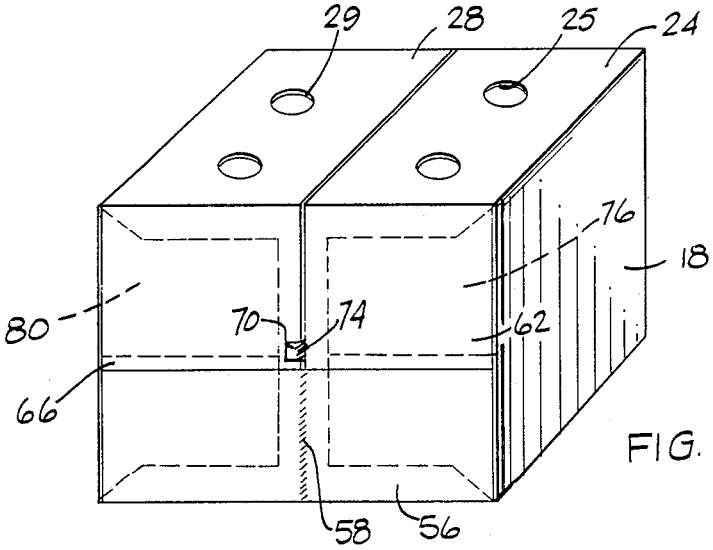
FIG. 6 is a pictorial view of the fully formed carrier of the invention.
Figure 3:
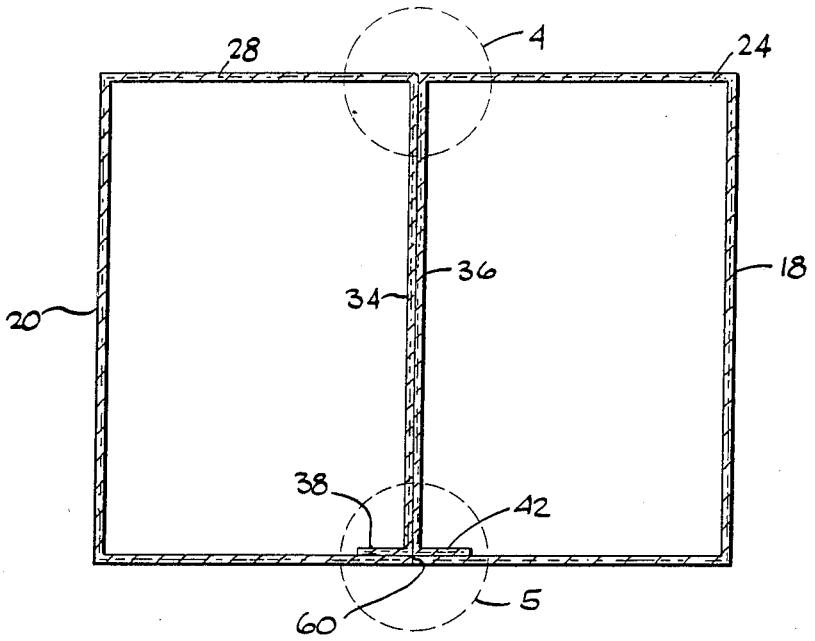
FIG. 3 is a transverse sectional view of the carrier taken on line 3—3 of FIG. 2.
Figure 4:
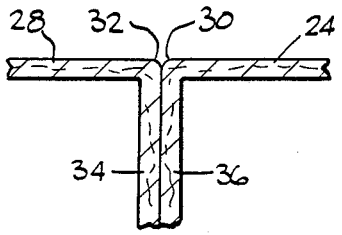
FIG. 4 is an enlarged partial sectional view of the upper portion of the partition contained within the dotted circle 4 in FIG. 3.
Figure 5:
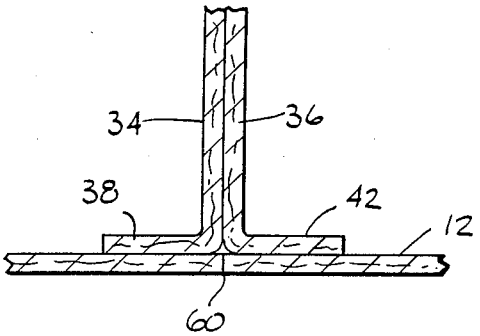
FIG. 5 is an enlarged partial sectional view of the lower portion of the partition contained within the dotted circle 5 in FIG. 3.

Referring to FIGS. 2 and 6, the formation of the carrier is completed by first folding in the dust flaps 76 and 80, folding the end flap 56 up against them, and then folding the connected end flaps 62 and 66 down. The end portions of the connected outer end flaps 62 and 66 overlap the inner end flap 56 and are glued together in the overlapped area. The end flaps 62, 66 and 56 are also glued to the dust flaps 76 and 80. The final configuration consists of a carton having aligned weakened areas in the bottom panel and in the inner end flaps. The top panel sections 24 and 28 are unconnected, as are the outer end flaps 62 and 66 except for the glue tabs 70 which hold the flaps 62 and 66 together. The weakened areas 74 at the base of the glue tabs are aligned with the weakened areas 58. It will be understood that the articles to be packaged have been omitted from the drawing for the purpose of clarity, but that they would have been introduced into the sleeve of FIG. 2 prior to closing the end flaps. The finished carrier of FIG. 6 can be carried by grasping the finger holes 25 and 29.

Figure 7:
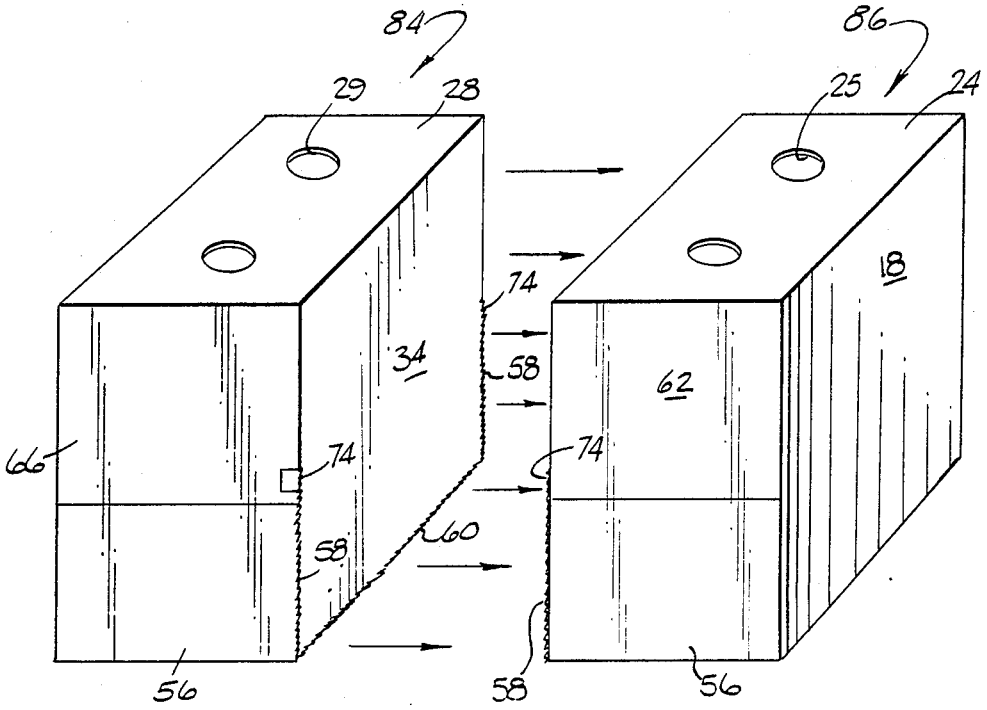
FIG. 7 is a pictorial view of the carrier after it has been separated into two smaller individual units.

To separate the carrier into two smaller units it is merely necessary to grasp the carrier and pull it in opposite directions as shown by the arrows in FIG. 7. This causes the weakened areas 58, 60 and 74 to tear, resulting in two separate enclosed units 84 and 86. The side panels of the carrier 84 are comprised of side panel 20 and partition panel 34, while the side panels of the other carrier 86 are comprised of side panel 18 and partition panel 36. The upper panel of each carrier unit contains its own finger holes so that each carrier unit is provided with its own handle.

Although the bottom panel of the carrier has been described as containing the weakened area adjacent to which the partition is connected, it will be understood that the panel containing the weakened area could be the upper panel instead. The finger holes would of course be provided in the upper panel regardless of where it is located in the blank.

Although the end flaps and the end tabs have been described as being connected by glue, it would be possible to utilize mechanical locking means instead. Glue is preferred, however, because the forming operation is fast, the resulting connection is strong and secure, and it is generally more appealing to the customer than a mechanically locked carton.

The finger holes disclosed herein are merely illustrative of one type of handle which can be provided in the carrier of the invention. If a stronger handle is needed due to the weight of the package, other known handle designs can readily be incorporated by those skilled in the art. Whatever the final handle design, handle means should preferably be provided on the upper panel of both smaller carrier units so that the separate units can be easily handled after the larger package has been separated.

It will now be appreciated that the carrier of the invention provides an inexpensive convenient relatively large carrier which can readily be broken into two separate smaller carriers for shipment to small retail outlets or by the final consumer if desired. The blank used to form the carrier requires a minimal amount of material and can readily be formed into the basic carrier in only a few operations. The tabs that connect the outer end panel flaps together provide a simple means for properly aligning the units and for holding the flaps in place until separation of the carrier, and the weakened area of the tabs allows separation to take place.

It should now be understood that the invention is not necessarily limited to all the specific details described in connection with the preferred embodiment, but that changes to certain features of the preferred embodiment which do not effect the overall basic function and concept of the invention may be made by those skilled in the art without departing from the spirit and scope of the invention, as defined in the appended claims.

What is claimed is:

1. A separable article carrier, comprising:

top and bottom panels connected along the length of the carrier to side panels;

one of the top and bottom panels containing a weakened area extending along the length thereof;

the other of the top and bottom panels being comprised of first and second panel sections;

a first partition connected to the first panel section along a first fold line intermediate the side panels, the first fold line extending throughout the length of the first panel section;

a second partition connected to the second panel section along a second fold line intermediate the side panels, the second fold line extending throughout the length of the second panel section;

the first and second fold lines and the first and second partitions being adjacent each other;

means connecting the first and second partitions to said one panel in the interior of the carrier in generally parallel relationship to the side panels and an opposite sides of the weakened area of said one panel;

end panels connected to the top and bottom panels along the width of the carrier;

each end panel being comprised of two end flaps, one end flap of each end panel being connected to said one panel and the other end flap of each end panel being connected to said other panel, the flaps being connected to each other;

said one end flap including a weakened area extending from the weakened area of said one panel completely across said one flap, the weakened area of said one flap being substantially parallel to the adjacent first and second partitions;

said other end flap being comprised of first and second independent flap sections having adjacent edges substantially aligned with the weakened area of said one end flap;

a relatively narrow tab on one of the first and second flap sections near an outer edge thereof and extending across the adjacent edges of the first and second independent flap sections, the tab being connected to the other of the first and second flap sections; and the tab including a weakened area aligned with the weakened area of said one end flap;

whereby the carrier can be separated along the weakened areas thereof into two smaller carriers, each of the first and second partitions thereby forming a side panel of one of the two smaller carriers.

2. A separable article carrier according to claim 1, wherein the tab is integral with one of the first and second flap sections and is glued to the other flap section.

* * * * *